US006183160B1

(12) United States Patent
Tapio et al.

(10) Patent No.: US 6,183,160 B1
(45) Date of Patent: Feb. 6, 2001

(54) SCREEDING APPARATUS AND METHOD INCORPORATING OSCILLATING ATTACHMENT

(75) Inventors: John A. Tapio; Nels D. Tapio; Kyle J. Tapio, all of Brush Prairie, WA (US)

(73) Assignee: Delaware Capital Formation, Inc., Wilmington, DE (US)

( * ) Notice: Under 35 U.S.C. 154(b), the term of this patent shall be extended for 0 days.

(21) Appl. No.: 09/052,193

(22) Filed: Mar. 31, 1998

(51) Int. Cl.[7] ..... E01C 19/22

(52) U.S. Cl. ..... 404/84.1; 404/84.5; 404/102; 404/120

(58) Field of Search ..... 404/84.05, 84.1, 404/84.5, 85.8, 101, 102, 114, 120

(56) References Cited

U.S. PATENT DOCUMENTS

| | | | |
|---|---|---|---|
| 1,033,872 | 7/1912 | Burwell . | |
| 1,677,877 | 7/1928 | Carr . | |
| 1,782,707 | 11/1930 | Bayley . | |
| 2,094,910 | 10/1937 | Baily | 94/48 |
| 2,219,246 | 10/1940 | Jackson | 94/45 |
| 2,322,362 | 6/1943 | Jackson | 94/45 |
| 2,346,378 | 4/1944 | Jackson | 94/48 |
| 2,346,379 | 4/1944 | Jackson | 94/24 |
| 2,358,085 | 9/1944 | Millikin et al. | 94/45 |
| 2,426,702 | 9/1947 | Millikin et al. | 94/45 |
| 2,473,961 | 6/1949 | Mandt et al. | 94/45 |
| 2,511,589 | 6/1950 | Jaeger | 94/45 |
| 2,566,481 | 9/1951 | Buell | 94/45 |
| 2,847,917 | 8/1958 | Heer et al. | 94/46 |
| 2,947,230 | 8/1960 | Heer et al. | 94/46 |
| 2,962,949 | 12/1960 | O'Dea | 94/45 |
| 3,051,062 | 8/1962 | Apel et al. | 94/45 |
| 3,088,384 | 5/1963 | Heer et al. | 94/46 |
| 3,147,678 | 9/1964 | Lewis | 94/45 |
| 3,221,618 | 12/1965 | Hudis | 94/45 |
| 3,247,770 | 4/1966 | Perkins et al. | 94/45 |
| 3,252,390 | 5/1966 | Martinson | 94/45 |
| 3,294,001 | 12/1966 | Thomson | 94/45 |

(List continued on next page.)

FOREIGN PATENT DOCUMENTS

| | | |
|---|---|---|
| 2555216A1 | 6/1977 | (DE) . |
| 3623570 | 1/1988 | (DE) . |
| 0102060 | 5/1985 | (EP) . |
| 332662 | 7/1930 | (GB) . |
| 909194 | 10/1962 | (GB) . |
| 1182385 | 2/1970 | (GB) . |
| 53878 | 2/1943 | (NL) . |
| 9401774 | 6/1996 | (NL) . |

OTHER PUBLICATIONS

SCRRR–EED™ concrete screed attachment by Van–Boh Systems, Inc. brochures, dated Jan. 1998.

"Are you tired of screeding concrete this way?", Screed King® TSK 308 brochure, published more than one year prior to the filing date of the present application.

*Primary Examiner*—James A. Lisehora
(74) *Attorney, Agent, or Firm*—Van Dyke, Gardner, Linn & Burkhart, LLP

(57) ABSTRACT

A screeding assembly and method is disclosed for spreading, grading, consolidating and smoothing loose or plastic material such as poured, uncured concrete when the assembly moved over an area of the material. The assembly includes a rotatable auger to move the material laterally across the path of travel, a vibratory screed positioned behind the auger to smooth and finish the material, and an elongated engaging member reciprocated laterally across the path at a position between the auger and vibratory screed to facilitate consolidation of the material. Preferably, a plow/striker is positioned in front of the auger to and remove excess material. The assembly may be mounted on a self-propelled vehicle or other support on a boom for moving the assembly over the material, and is preferably controlled by a laser beam responsive elevation control. A kit for attaching the reciprocating engaging member to an existing screed assembly is also provided.

55 Claims, 9 Drawing Sheets

U.S. PATENT DOCUMENTS

| | | | |
|---|---|---|---|
| 3,377,933 | 4/1968 | Dale | 94/45 |
| 3,435,740 | 4/1969 | McGall | 94/45 |
| 3,533,337 | 10/1970 | Swisher, Jr. et al. | 94/46 |
| 3,602,112 | 8/1971 | Burks | 94/44 |
| 3,604,325 | 9/1971 | Borges | 94/45 |
| 3,638,539 | 2/1972 | Lewis | 94/44 |
| 3,838,933 | 10/1974 | Lehman et al. | 404/114 |
| 3,850,541 | 11/1974 | Baillet et al. | 404/114 |
| 3,870,427 | 3/1975 | Allen | 404/103 |
| 3,970,405 | 7/1976 | Swisher, Jr. et al. | 404/105 |
| 4,073,592 | 2/1978 | Godberson et al. | 404/89 |
| 4,253,778 | 3/1981 | Morrison | 404/114 |
| 4,371,287 | 2/1983 | Johansson | 404/84 |
| 4,465,397 | 8/1984 | Hollon et al. | 404/84 |
| 4,466,757 | 8/1984 | Allen | 404/114 |
| 4,484,834 | 11/1984 | Rowe | 404/84 |
| 4,493,585 | 1/1985 | Axer | 404/102 |
| 4,507,015 | 3/1985 | Furukawa et al. | 404/103 |
| 4,655,633 | 4/1987 | Somero et al. | 404/75 |
| 4,700,786 | 10/1987 | Berry | 172/799 |
| 4,930,935 | 6/1990 | Quenzi et al. | 404/75 |
| 4,978,246 | 12/1990 | Quenzi et al. | 404/84 |
| 5,009,544 | 4/1991 | Chaize | 404/72 |
| 5,156,487 | 10/1992 | Haid | 404/72 |
| 5,222,829 | 6/1993 | Mogler et al. | 404/118 |
| 5,224,793 | 7/1993 | De Pol et al. | 404/119 |
| 5,366,320 | 11/1994 | Hanlon et al. | 404/118 |

180
186
196
192
202
200
204
234
XI
236
194
198
170
206
208
214
216
210
222
212
220
218
172
178
184
104
188
190
240
239
230
232
XII
238

SCREEDING APPARATUS AND METHOD INCORPORATING OSCILLATING ATTACHMENT

BACKGROUND OF THE INVENTION

This invention relates to methods and machines for screeding, that is, spreading, distributing, grading and smoothing and/or leveling placed and/or poured, uncured concrete or like loose, spreadable material such as sand, gravel or relatively viscous, fluid materials. More particularly, the invention concerns an apparatus and method for screeding such materials without the need for pre-positioned rails or guides, especially rail guided paving and screeding machines such as slip form pavers. The invention is an improvement of an earlier apparatus and method for screeding such materials with a device which is supported above and moved along an area of such loose or plastic material like uncured concrete.

The present invention is an improved version of the screeding apparatus and methods of U.S. Pat. Nos. 4,930,935 and 4,655,633, both of which are assigned to the assignees of the present invention. In the device and method of U.S. Pat. No. 4,930,935, a self-propelled apparatus includes a steerable, self-propelled frame, a cantilevered boom, and an auger-type, vibratory screed having a strike-off member for engaging the concrete prior to engagement by the auger while the vibratory screed smooths the concrete after engagement by the auger. The elevation of the screed is adjusted automatically by a screed control assembly relative to a laser beacon reference plane positioned off of and remote from the apparatus such that the finished height of the concrete or other material is accurately controlled within close tolerances.

During use of the vibratory screed of U.S. Pat. No. 4,930,935, it was found that with certain types of materials, and especially stiffer or partially set concrete, or large aggregate concrete, the screed assembly of U.S. Pat. No. 4,930,935 encountered difficulties in closing all voids and openings in the concrete and producing the same high quality finished surface while operating at a normal screeding speed. Specifically, with concrete which had partially setup or was held in a concrete delivery truck for too long a time, or was placed in a thinner layer such as low slump two or three inch thick layers, or included large size stone or aggregate in the mixture, the screeding apparatus of U.S. Pat. No. 4,930,935 was required to labor more and be moved over the surface of the poured concrete more slowly in order to produce the same quality finished surface. Particularly when aggregate of large size was used in such concrete, unless the screed assembly was operated at a slower rate of movement, voids in the surface of the concrete were not fully closed. Accordingly, in such situations, the square footage area of concrete which could be finished and screeded in a given work period was reduced because of such slower operating speed. Completion of projects was, thus, delayed while the expense of concrete finishing was increased.

Accordingly, the present invention was devised to improve the screeding and/or finishing of material such as poured, uncured concrete and especially stiffer concrete which is low slump, large aggregate, or partially set, by including an additional oscillating/reciprocating element to better consolidate the concrete being worked at normal screeding speeds while eliminating voids and openings, and thereby provide a smooth high quality, properly finished surface.

SUMMARY OF THE INVENTION

The present invention is an improved screeding apparatus and method for spreading, distributing, smoothing, leveling and/or grading placed and/or poured, uncured concrete or like loose, spreadable, viscous fluid or plastic materials on the ground or on suspended decks, parking structures or other surfaces to allow finishing of the concrete or other material at normal screeding speeds and without the use of large, slip formed pavers or other apparatus requiring the use of preset guides or rails. More particularly, the present invention is adapted to allow screeding at normal speeds even when finishing stiffer concrete such as low slump, large aggregate, or partially set concrete which otherwise would incorporate significant voids or openings.

In one aspect, the invention is a screeding assembly for uncured concrete or other material adapted to be supported and moved along a path in a predetermined direction over an area of the material to be screeded. The assembly includes a support, an elongated, rotatable auger having an axis of rotation generally transverse to the predetermined direction and mounted on the support to move the material laterally of the predetermined direction and grade the material, and a vibratory screed mounted on the support and positioned behind the auger with respect to the predetermined direction to smooth the material. An elongated engaging member is mounted on the support and positioned intermediate the auger and the vibratory screed to engage and smooth the material. An oscillating assembly reciprocates the engaging member in a direction generally parallel to the axis of rotation of the auger whereby the material is spread across the path, graded and smoothed at a desired height above the ground or support surface by the assembly when the assembly is moved in the predetermined direction along the path.

Preferably, the screeding assembly also includes an elongated plow/striker mounted on the support and spaced in front of the auger with respect to the predetermined direction to remove excess material and spread the material as the screeding assembly is moved.

Preferably, the screeding assembly also includes an adjustment assembly for raising and lowering the elongated engaging member with respect to the material to be screeded. The oscillating assembly preferably includes at least one slide member on the engaging member, a bearing member on the support for slidingly supporting the slide member, a camming member attached to the engaging member, and a motor for moving the camming member to reciprocate the slide member and engaging member on the bearing member. In a preferred form, the adjustment mechanism includes a slide support mounted on the support, the oscillating assembly being mounted on the slide support, and a manually-operable adjustment member, such as a threaded rod, operable to slidably move the slide support and oscillating assembly with respect to the support toward an away from the material. Preferably, vibration isolation members, such as rubber or other resilient mounts, are provided for isolating any vibration of the engaging member and oscillating assembly from the remainder of the screeding apparatus.

In other aspects of the invention, an improved screeding apparatus for loose or plastic material, such as placed and/or poured, uncured concrete previously placed on the ground or another support surface includes a support for supporting the apparatus on the ground or a support surface, a boom extending outwardly from the support, a boom support which mounts the boom on the support, a screed assembly, and a screed mount for mounting the screed assembly on the boom. The screed assembly is elongated and includes an elongated, rotatable auger having an axis of rotation generally transverse to the predetermined direction and mounted on the screed mount to move the material laterally of the predetermined direction of the auger axis and grade the material. A vibratory screed is also mounted on the screed mount and is positioned behind the auger with respect to the predetermined direction to smooth the material. An elongated engaging member is mounted on the screed mount and positioned intermediate the auger and the vibratory screed to engage and smooth the material. An oscillating assembly reciprocates the engaging member in a direction generally parallel to the axis of rotation of the auger whereby the material is spread across the path, graded, and smoothed at a desired height above the ground or other support surface when the assembly is moved in the predetermined direction along the path.

In a preferred form, the screeding apparatus may include an elongated plow/striker mounted on the screed mount and spaced in front of the auger with respect to the predetermined direction to remove excess material as the screeding assembly is moved in that direction. A pivot assembly is preferably included for pivotally mounting the screed assembly on a first pivot axis extending generally parallel to the direction of elongation of the screed assembly and a motive power unit pivots the screed assembly about the pivot axis such that contact of the plow/striker, the oscillating/reciprocating engaging member and the vibratory screed with the material may be varied and adjusted to counteract the force of the material engaging the screed assembly during movement and to maintain proper screeding contact with the material. Further, a level sensor is preferably included on the screed assembly for sensing the position and degree of rotation of the screed assembly about the first axis while a control responsive to the level sensor actuates the motive power unit to pivot the screed assembly about the first axis.

In other aspects, the boom which supports the screeding assembly may comprise a telescoping boom having a plurality of boom sections movable with respect to one another and the support, the screed assembly being mounted at one end of one of the boom sections and including boom power source for extending and retracting the boom sections and screed assembly.

In other aspects, an elevation assembly raises and lowers the screed assembly with respect to the boom and preferably includes a screed elevation beam, spaced elevation tubes secured to the screed assembly at opposite ends of the screed elevation beam, and a pair of fluid cylinders for raising and lowering the elevation tubes with respect to the elevation beam. Preferably, a laser beam responsive control on the screed assembly is responsive to a fixed laser reference plane for controlling the raising and lowering of the screed assembly with the elevation assembly.

In yet other aspects of the assembly, a kit is provided for mounting an oscillating/reciprocating material engaging member on a screed assembly, the screed assembly adapted to spread, smooth and finish loose or plastic materials, such as placed and/or poured, uncured concrete previously placed on the ground or another support surface. The screed assembly is of the type including an elongated rotatable auger and a vibratory screed. The kit comprises an elongated engaging member, an oscillating assembly for mounting the engaging member on the support at a position adjacent the auger and for reciprocating the engaging member in a direction generally parallel to the axis of rotation of the auger, and a pair of extension plates for attachment to the support and supporting the vibratory screed at a position spaced behind the auger with respect to the predetermined direction to allow support and reciprocation of the engaging member at a position between the auger and vibratory screed.

In another aspect, the invention is an improved screeding method including providing a screed assembly having a rotational auger for moving the material in a lateral direction across the path of travel of the screed assembly and a vibratory screed positioned behind the auger with respect to the path of travel for engaging and smoothing the material. The method includes moving the screed assembly through the material in a predetermined direction to spread, grade and smooth the material while rotating the auger and vibrating the vibratory screed. The method also includes reciprocating an elongated engaging member on the material in a lateral direction at a position between the auger and the vibratory screed while moving the screed assembly through the material.

Accordingly, the present screeding apparatus and method provide improvements and advantages over prior known screeding structures and methods. The inclusion of the reciprocating/oscillating elongated member facilitates consolidation of the material such as on poured, uncured concrete especially of the stiffer consistency such as low slump (0 to 3 inches), large aggregate, or partially set-up concrete so as to better close the voids and openings in the concrete and provide a smooth, finished surface after engagement by the vibratory screed which follows the elongated member. When the oscillating elongated member is positioned between the rotational auger and vibratory screed, the oscillating engaging member contacts the open and torn texture left by the rotational auger and transforms the surface texture to a semi-closed surface which allows the vibratory screed to finish the surface preparation much more easily. In addition, in the event the vibratory screed fails to function, the use of the oscillating engaging member substantially closes the voids and opening in the surface left by the rotational auger. In addition, the oscillating engaging member helps consolidate the aggregate in low slump concrete.

Further, the reciprocal action of the engaging member creates a motion in semi-hardened concrete that allows the fresh concrete that has been placed or poured from a second load on top of or next to the semi-hardened concrete poured from another load in an adjacent area to blend together with the semi-hardened concrete to create a uniform transition of the two different mixes or loads. By blending the two materials that are curing at different speeds, or if, in fact, one area or load is at a more advanced stage of curing or set up, the reciprocating motion of the engaging member creates a uniform transition and a better quality concrete surface along with a blending and mixture of the materials from the two loads. Such blending allows the blended and mixed portion to set up and cure at a rate of speed which is slower than the older concrete and yet faster than the fresher concrete. This blending action helps eliminate and minimize a cold joint which otherwise would be formed between the two areas, and helps prevent cracking while allowing blending of the textured surfaces of the two different loads so that the transition from one load to the next is not as identifiable as would be if the loads were not blended in this manner. In addition, the reciprocal action of the engaging member allows concrete to be screeded at a lower slump which, in turn, allows immediate application of a broom textured surface without causing superficial damage to the surface. Further, by placing and screeding concrete at a lower slump, it allows faster set up and curing of the concrete, thereby enabling walking on the surface at an earlier time without damaging the broom textured appearance. Also, the screeding of lower slump concrete allows the concrete to be Soff cut at an earlier time and helps reduce final finishing labor.

Moreover, the oscillating engaging member greatly facilitates the striking off and screeding of an area that has a high percent of slope. During screeding of a sloped surface, the concrete c an easily bubble under the vibratory screed and flow back down the slope if the slope is pronounced. In this situation, the screeding operator could elect to shut off the vibratory screed and use the oscillating engaging member to work the surface.

The invention also provides a kit for converting previously existing screeding assemblies of the type including a rotatable auger and vibratory screed to include the engaging member and an oscillating assembly for reciprocating the engaging member on the material at a position between the auger and vibratory screed to better consolidate the material or uncured concrete. When the screed assembly includes the oscillating/reciprocating engaging member, and the screed assembly is mounted on the screeding apparatus as described herein, the boom supporting the screed assembly may be operated and retracted at its normal speed or faster while still properly consolidating and finishing the concrete at a desired height thereby enabling more efficient operation and screeding of larger quantities of poured concrete during a working day, all with a high quality finish.

These and other objects, advantages, purposes and features of the invention will become more apparent from a study of the following description take in conjunction with the drawings.

BRIEF DESCRIPTIONS OF THE DRAWINGS

DESCRIPTION OF THE PREFERRED EMBODIMENTS

Figure 1:
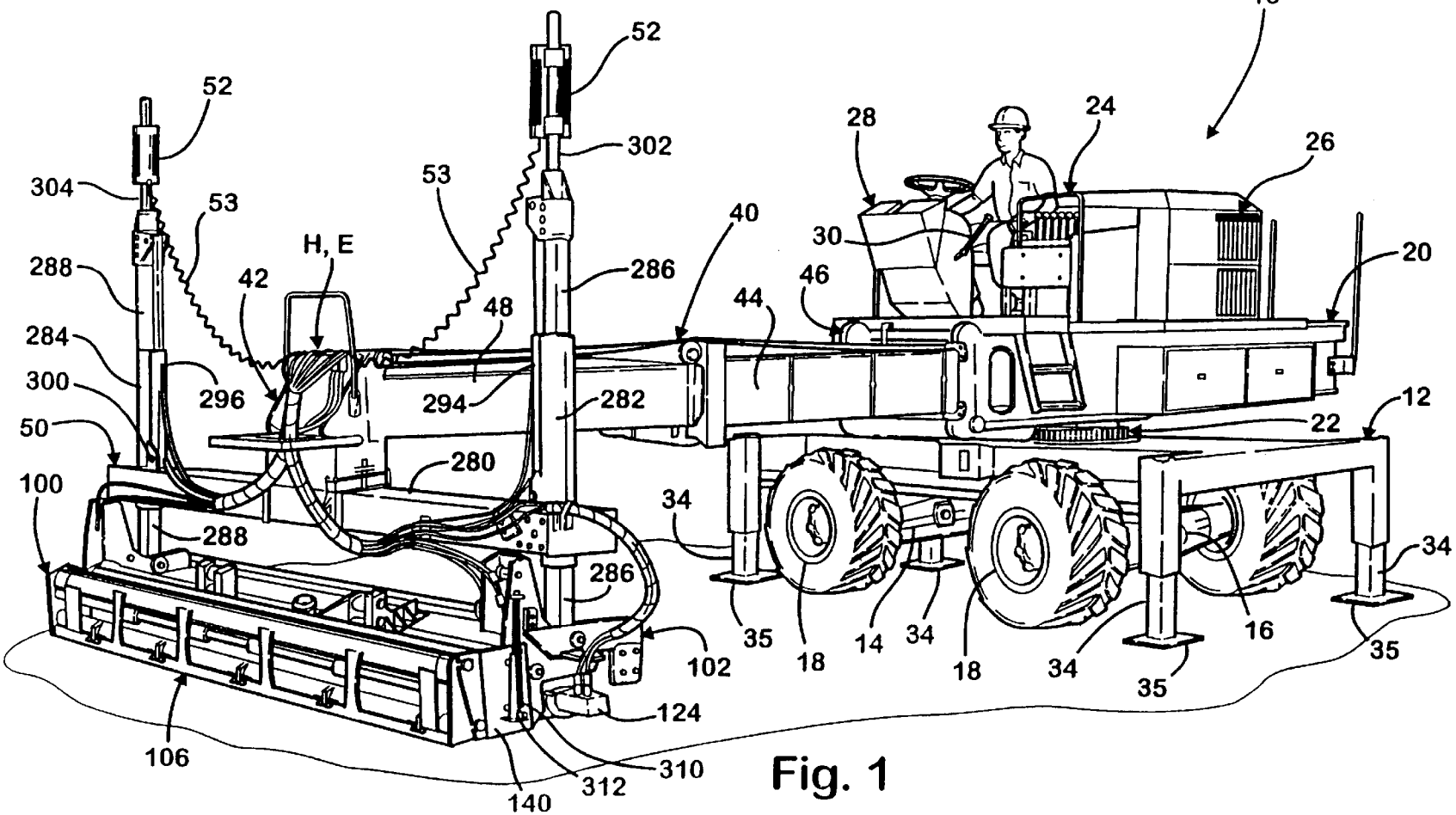
FIG. 1 is a perspective view of a self-propelled, laser guided, screeding apparatus incorporating a screeding assembly having an oscillating/reciprocating engaging member in accordance with the present invention.
Figure 2:
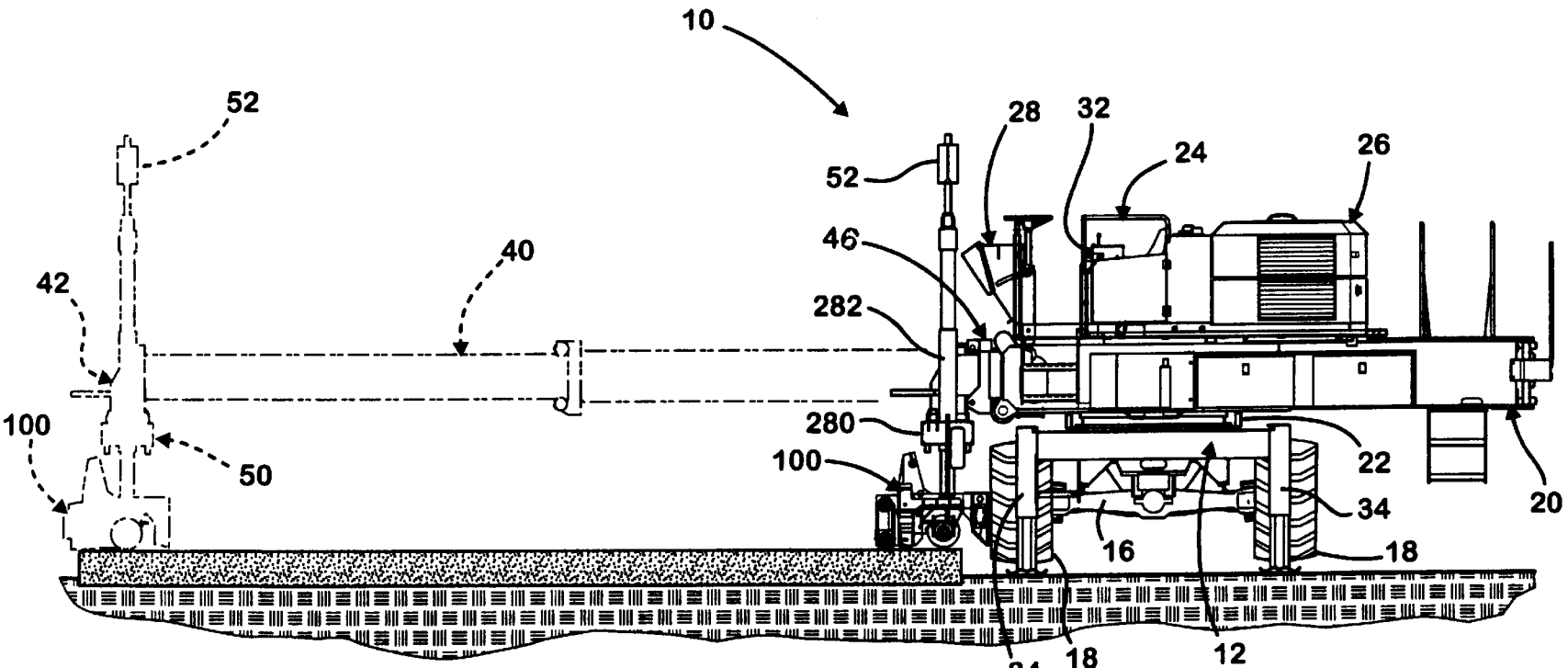
FIG. 2 is a side elevation of the screeding apparatus of FIG. 1.
Figure 3:
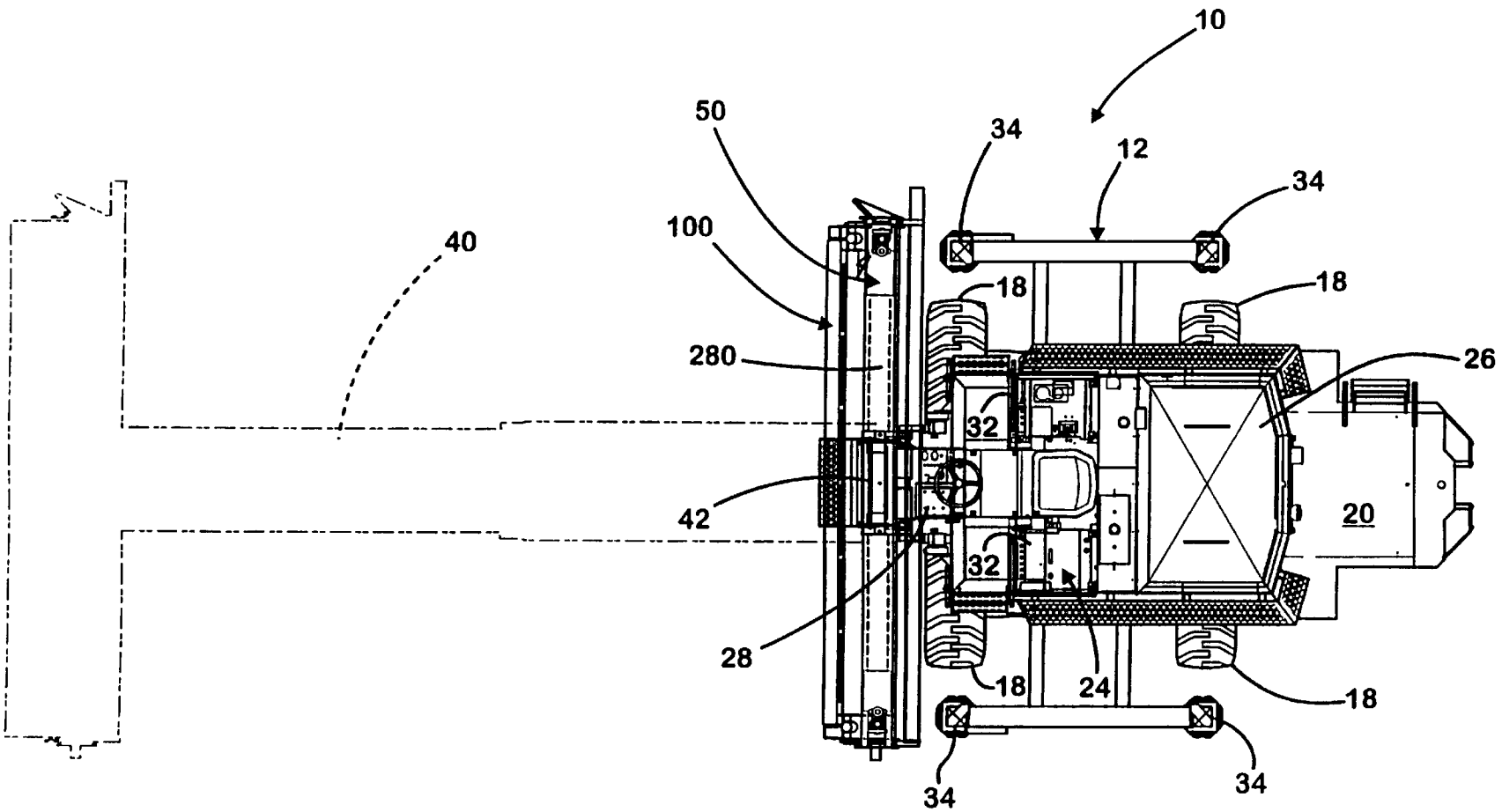
FIG. 3 is a top plan view of the screeding apparatus of FIGS. 1 and 2.

Referring now to the drawings in greater detail, FIGS. 1–3 illustrate a preferred form of an improved, self-propelled screeding apparatus 10 embodying the present invention. The screeding apparatus or machine 10 is a revised, improved version of the prior machine of U.S. Pat. No. 4,930,935 entitled SCREEDING APPARATUS AND METHOD, the disclosure of which is hereby incorporated by reference herein. Like the earlier machine, machine 10 is also designed for striking off, grading, leveling, smoothing, i.e., screeding concrete or other materials in restricted or open areas, but is particularly advantageous in areas in which it is inconvenient to lay support rails or guides and/or position large, rail supported screeding apparatus or slip form pavers. The present machine is also highly useful for screeding large areas of concrete since it avoids the necessity of laying a first strip which must harden before an adjacent strip can be poured or finished. In addition, the present machine provides improved leveling, grading and screeding efficiency, especially for stiffer, low slump, large aggregate or partially set-up concrete, while providing a compact apparatus which may be positioned and more easily used within confined areas in which concrete is to be laid.

OVERALL ASSEMBLY

As shown in FIGS. 1–3, machine 10 includes a lower support frame 12 having front and rear propulsion support axles 14, 16 each of which provide both propulsion and steering capability, four support wheels 18 preferably including rubber tires, and upper frame 20 which is rotatable on a large bearing 22 supported on lower frame 12 and includes an operator support platform 24 along with an engine/hydraulic pump compartment 26. The wheels on axles 16, 18 are individually powered by hydraulic motors. Bearing assembly 22 is substantially similar to that described in U.S. Pat. No. 4,655,633, the disclosure of which is hereby incorporated by reference herein, and is powered by an hydraulic rotation motor which rotates the upper framework 20 with respect to the lower framework 12 through 360°. Appropriate controls for the machine are positioned on a tiltable instrument/steering console 28 which may be locked with locking handle 30 either in an operating position (not shown) or an upright withdrawn position (shown in FIG. 1) allowing entry of the operator. Additional controls 32 (FIGS. 2 and 3) are located to the left and right of the driver's seat. Four extendable, telescoping stabilizer legs 34, one at each corner of support frame 12, each including a ground engaging foot or plate 35 extend downwardly for extension and retraction by separate hydraulic cylinders to engage the ground or other support surface when the screeding apparatus is positioned adjacent an area of material such as uncured concrete to be screeded. Extension of the legs lifts the entire apparatus off wheels and tires 18 to provide a stabilized support platform during the screeding operation. Upper frame 20 also provides support for the telescoping boom assembly 40.

Boom 40 extends outwardly from upper frame portion 20 below the operator's, platform 24 and is mounted for horizontal, telescoping extension and retraction on suitable bearings. On the outer, free end of boom assembly 40 is a screed mounting assembly 42 to which screed elevation assembly 50 is attached. A screed assembly 100 is, in turn, mounted to be raised and lowered with respect to the material to be screeded on elevation assembly 50. An automatic screed elevation control system, preferably using laser beacon receivers 52, is included on screed elevation assembly 50 and is connected to an appropriate control mounted on operator platform 24 on upper frame portion 20. By means of the rotatable upper frame portion 20, boom 40 carrying screed mounting assembly 42, screed elevation assembly 50 and screed assembly 100, may be rotated 360° around lower frame 12 on bearing 22 for spreading, distributing, smoothing and/or grading and leveling, i.e., screeding the placed and/or poured, uncured concrete adjacent the machine.

As will be understood from U.S. Pat. No. 4,930,935 incorporated by reference herein, boom 40 may be rotated such that it extends rearwardly behind frame 12 and axle 16 with screed assembly 100 positioned behind the rear support wheels 18 and axle 16. In this configuration, machine 10 may be driven through the placed and/or poured, uncured concrete with the smoothing and finishing proceeding behind the rear wheels as the apparatus moves slowly through the concrete. Preferably, any tracks are filled in as the concrete or other material is smoothed therebehind.

Figure 5:
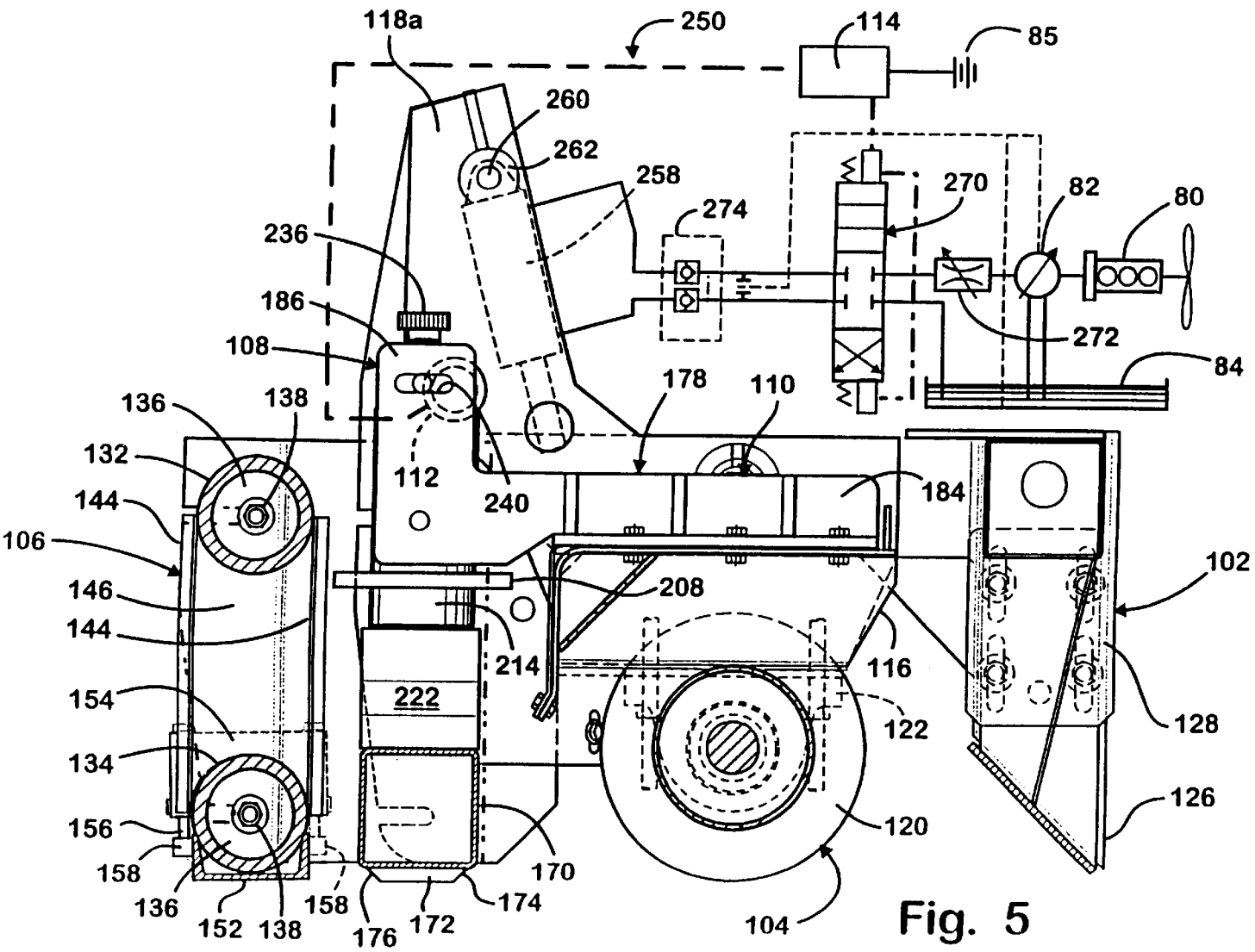
FIG. 5 is a sectional end elevation of the screeding assembly of the present invention also showing a hydraulic schematic for operating the level sensor controlled pivoting apparatus which counteracts the force of concrete during operation of the screeding assembly.
Figure 6:
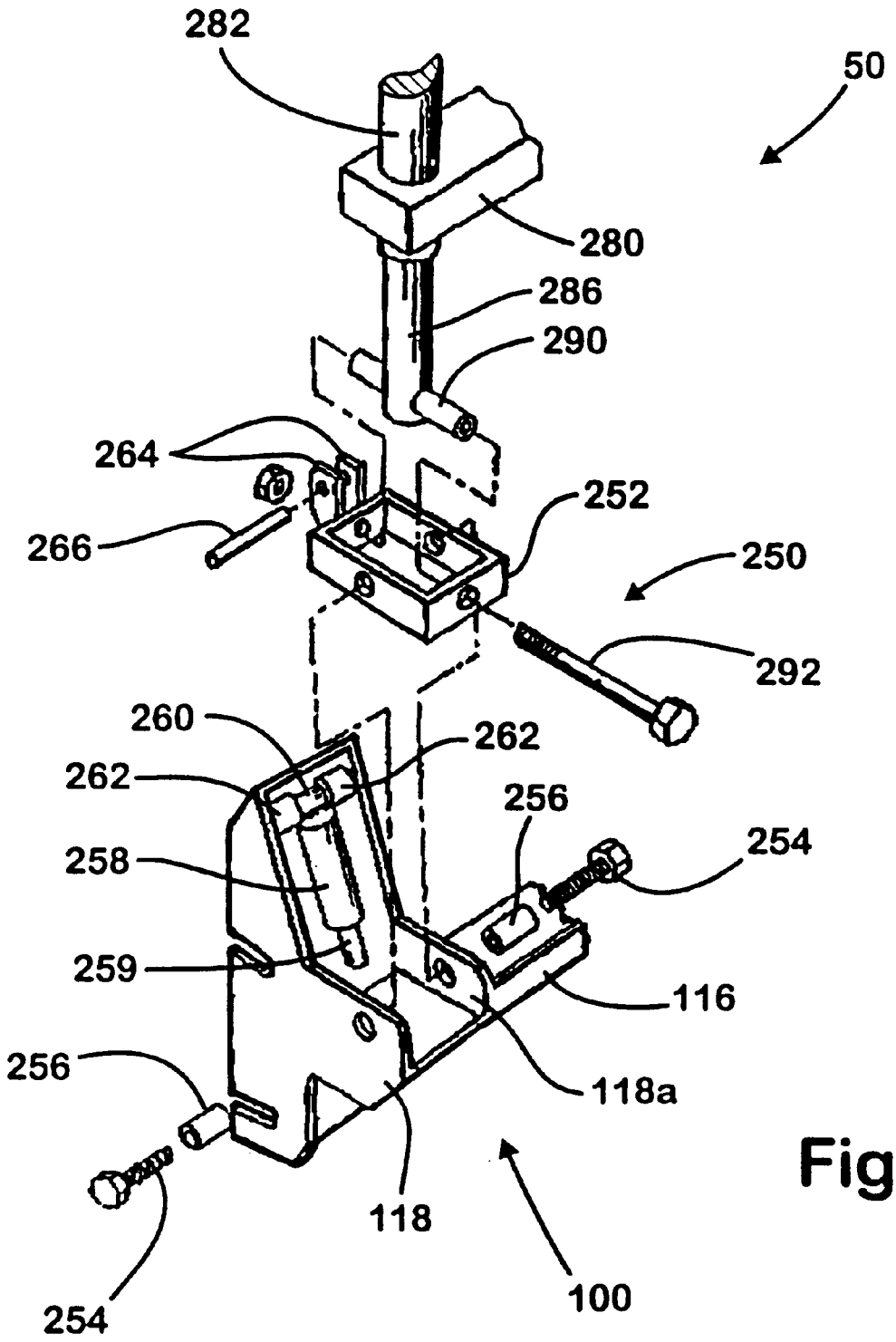
FIG. 6 is an exploded perspective view of the pivot yoke and pivot assembly for supporting the screeding assembly on the boom.
Figure 7:
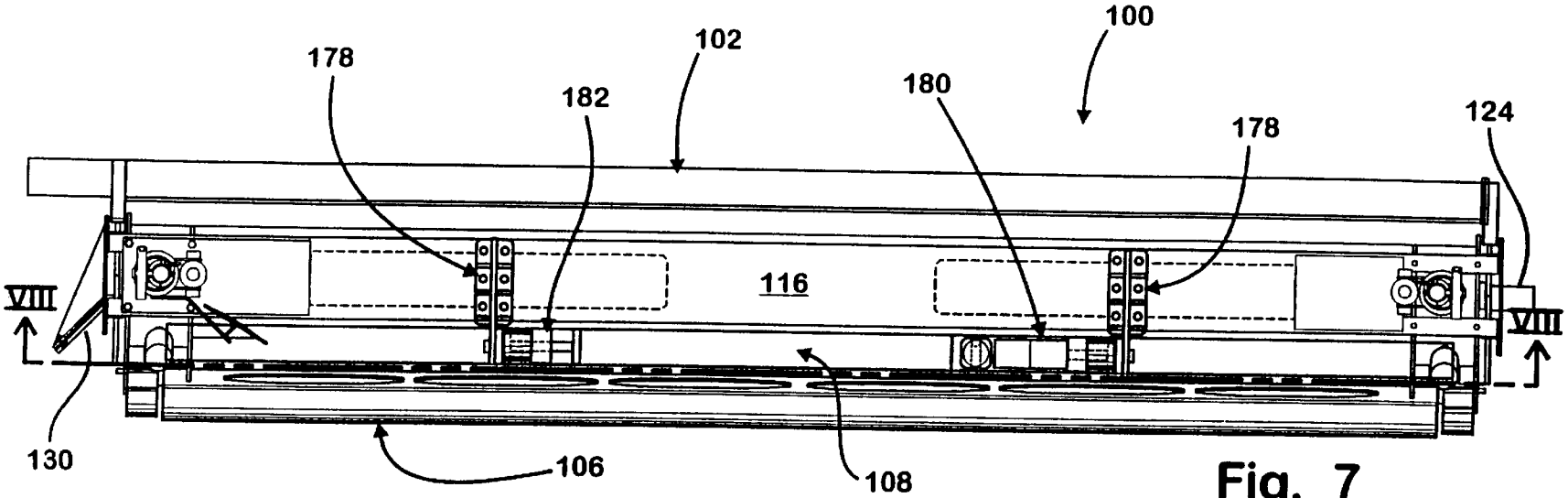
FIG. 7 is a top plan view of the screeding assembly.
Figure 8:
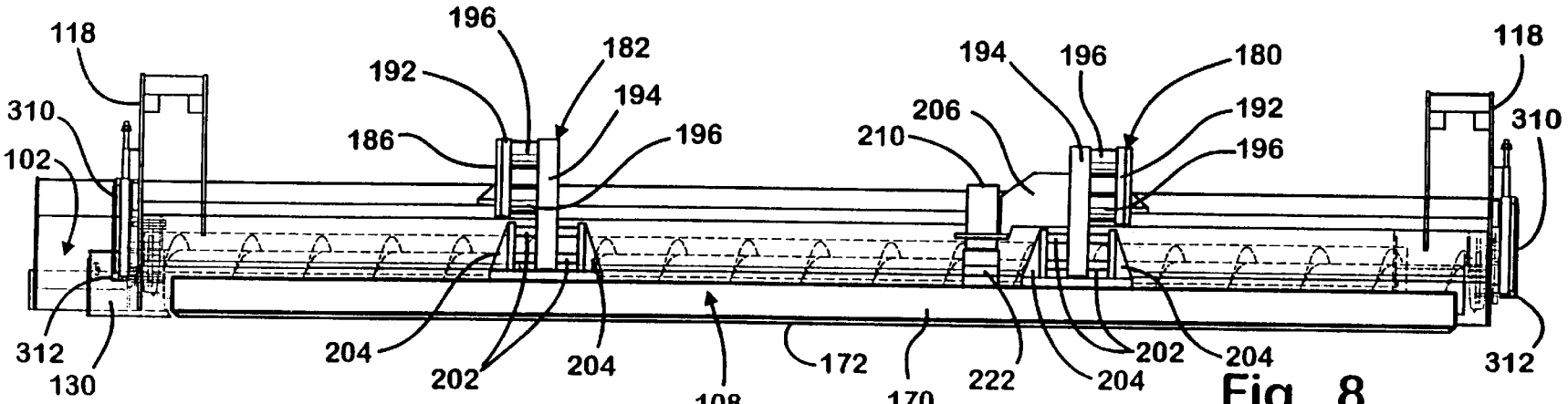
FIG. 8 is a sectional front elevation of the screeding assembly.
Figure 13:
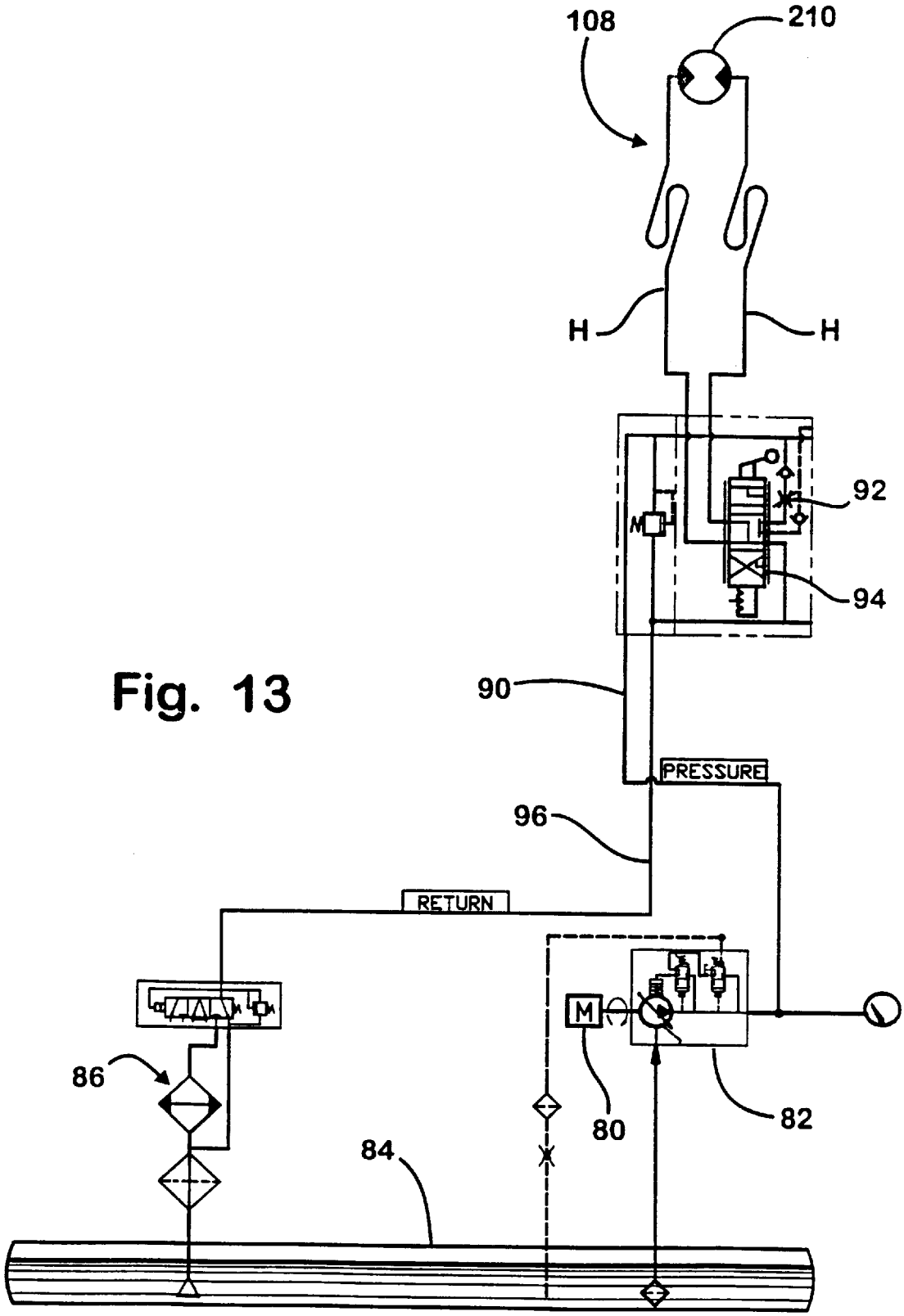
FIG. 13 is a schematic illustration of the hydraulic system for operating the oscillating assembly of the present invention.

Mounted within engine compartment 26 are a conventional internal combustion diesel, gasoline or electric engine 80 (FIG. 5). Engine 80 provides power to a single, variable displacement, hydraulic pump 82 (FIG. 5) which is preferably load sensing and draws and returns hydraulic fluid from tank or reservoir 84 (FIG. 13). Engine compartment 26 also houses a battery 85 (FIG. 5) for starting engine 80 and providing power to the various electrical controls and various hydraulic system components including an hydraulic fluid filter 86 (FIG. 13) and the like. Preferably, hydraulic reservoir or tank 84 is housed within the engine compartment 26 on upper frame 20.

The principal changes in the present improved screeding apparatus and method are more fully described hereinafter and include an oscillating/reciprocating, elongated, engaging member 108 in the form of a strip or bar which is positioned intermediate the rotational auger assembly 104 and vibratory screed 106 of screed assembly 100, as is more fully explained below. The oscillating/reciprocating engaging member 108 moves laterally to and fro, transversely across the path of travel of the screeding assembly as it is moved by boom assembly 40 over the material to be screeded and helps consolidate and fill the voids within stiffer consistency concrete, such as, partially set, low slump, or large aggregate concrete, such that the vibratory screed can properly complete the smoothing and finishing of the concrete thereafter.

For purposes of the present application, the apparatus and method will be understood to principally refer to the placement, i.e., screeding, of previously poured, uncured concrete or like loose, spreadable material, such as sand, gravel, asphalt or other viscous fluid materials previously placed on the ground or on other surfaces, such as in parking ramps, on decks, in buildings or the like. The present apparatus and method is especially useful in stiffer, low slump, large aggregate, or partially set but uncured concrete. It will be recognized, however, that the present apparatus and method avoids the use of pre-positioned guide rails or supports for the screeding apparatus thereby eliminating significant amounts of labor and expense in the concrete finishing operation.

The hydraulic fluid circuit used in conjunction with apparatus 10 and pump 82 is preferably a closed center, load sensing system with manually adjustable flow controls for all functions of the machine which require speed control. Variable displacement pump 82 provides a volume of hydraulic oil required for functions being used at a pressure of approximately 200–400 psi above the pressure required by the function requiring the highest pressure. If no functions are being used, the pump will provide just enough flow to make up for internal pump leakage, valve leakage, and load sense bleed-down leakage and also to maintain a pressure of 200–400 psi. Apart from the specific controls for the oscillating/reciprocating engaging member 108, the telescoping boom controls, dual propulsion motors, single variable displacement pump operation, and the other hydraulic system and controls are substantially similar to those used in the apparatus of U.S. Pat. Nos. 4,655,633 and 4,930,935. The hydraulic system also includes a rotatable hydraulic swivel assembly such as that used in U.S. Pat. No. 4,655,633 which is mounted to project downwardly from upper frame 20 and upwardly through the center of the rotational bearing assembly 22 to provide fluid communication between the upper rotating framework 20 (where the internal combustion engine 80 and hydraulic pump 82 are located) and the lower framework 12 (where numerous fluid motors or connections to fluid motors are located).

As will be understood from FIGS. 1–3, boom assembly 40 is substantially as described in U.S. Pat. No. 4,930,935 and includes a large, hollow boom section 44 telescopically inserted and nested within the interior of a boom support structure 46 on suitable bearings under operator platform 24 on upper frame 20. A slightly smaller outer boom section 48 is telescopically inserted within large boom section 44 on suitable bearings. Boom sections 44, 48 are extended and retracted from boom support structure 46 by means of a fluid power cylinder and pulley and cable system as described in U.S. Pat. No. 4,930,935 mounted within upper frame 20 and as controlled by the operator.

Preferably, a hydraulic hose and electric cable support assembly is included within large boom section 44 for extension and take up of the hydraulic hoses H and electrical cables E (FIG. 1) leading from the lower portion of the upper frame assembly 20 forwardly to the outer free end of smaller boom section 48, all as described in U.S. Pat. No. 4,930,935.

SCREED ASSEMBLY AND SCREED ELEVATION ASSEMBLY AND CONTROL SYSTEM

Figure 4:
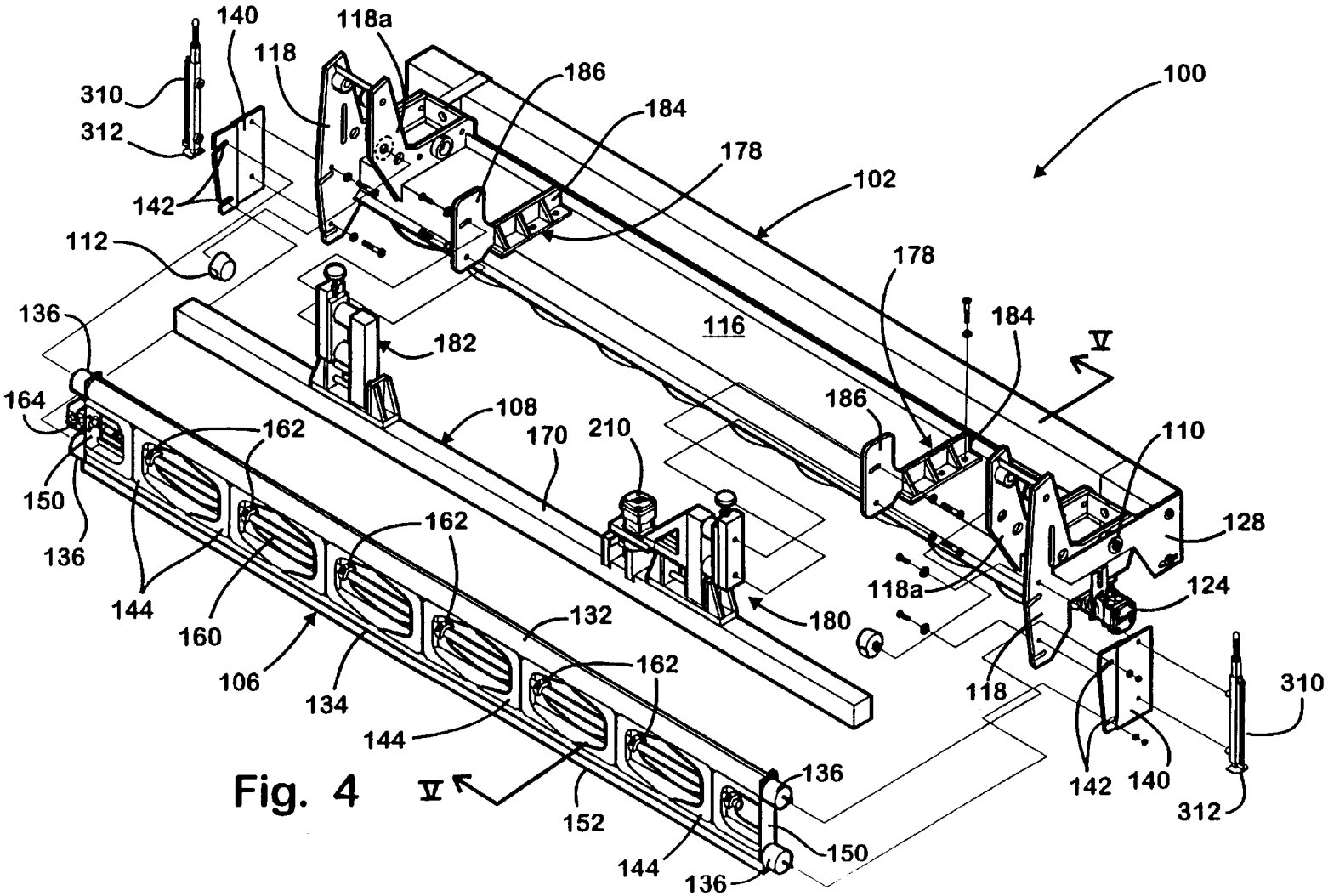
FIG. 4 is an exploded, perspective view of the screeding assembly of the present invention incorporating the engaging member and oscillating assembly therefor.

Referring now to FIGS. 1–3 and 4–12, screed assembly 100 is mounted on screed mounting assembly 42 such that assembly 100 may be moved toward and away from the upper frame 20 and lower support frame 12 on telescoping boom assembly 40 by means of a boom operating fluid cylinder and pulley and cable assembly as described above. As is best seen FIGS. 1 and 4–8, screed assembly 100 is an improved version of the screed assembly of U.S. Pat. No. 4,930,935, and includes a plow or striker 102 positioned in front of (i.e., on the side facing frame 12) rotational auger 104 with respect to the preferred direction of motion of the screed assembly on boom assembly 40. A vibrationally isolated, vibratory screed 106 is positioned behind rotational auger 104 with respect to the direction of travel of the screed assembly. In addition, screed assembly 100 includes an oscillating/reciprocating engaging member 108 positioned between and intermediate the positions of rotational auger 104 and vibratory screed 106 as is best seen in FIGS. 4 and 5. In addition, screed assembly 100 includes a pivot axis 110 and an electrohydraulic level sensing unit 112 (FIG. 4) and an associated control 114 (FIG. 5) for automatically counteracting the force of concrete or other material to be screeded which acts against the plow/striker 102 and which would otherwise change the position of the plow, engaging member and vibratory screed and prevent effective screeding.

Screed assembly 100 includes an elongated horizontally extending screed support beam 116 (FIG. 4) including a pair of spaced, vertically extending, extension end plates 118 at either end of the beam. Centrally located beneath support beam 116 is a rotational auger assembly 104 including a continuous, helical auger 120 (preferably about twelve feet in length in the preferred embodiment) rotationally mounted generally parallel to beam 116 on a pair of spaced pillow blocks 122, one at either end of the support beam 116. Pillow blocks 122 are bolted to a bearing support on the underside of support beam 116 adjacent end plates 118. Auger assembly 104 is preferably rotated by a single hydraulic motor 124 (FIGS. 4 and 7) located at one end of the screed assembly such as the left end. This causes concrete to be moved left or right along the axis of the auger blade 120 in a lateral direction generally perpendicular to the direction in which screed assembly 100 is moved by boom 40 depending on the directional rotation in which hydraulic motor 124 is operated.

Spaced forwardly of rotational auger assembly 104 at the front edge of support beam 116 is an elongated plow 102 having a mold board 126 and end plates 128 (FIGS. 4 and 5). Plow 102 is secured rigidly to the front edge of beam 116 such that it establishes the initial rough grade or concrete height by removing excess concrete in front of auger assembly 104 while allowing a predetermined portion of the concrete to pass therebeneath. As auger 120 is rotated, it carries concrete toward one end of the screed assembly 100. End plow 130 (FIG. 7), which is preferably mounted at the downstream end of auger 120 toward which the concrete is moved, deflects the concrete away from the same end of vibratory screed 106 thereby preventing any buildup of concrete at that end.

On the rear side of screed assembly 100 is a vibrationally isolated, vibratory screed 106 best seen in FIGS. 1, 4 and 5. Screed 106 includes a pair of elongated, continuous, one-piece cylindrical tubular beams 132, 134 each having end caps at opposite ends closing the tubes. At the ends of each tube are resilient cylindrical mounts 136, preferably formed from rubber or another resilient material, secured in place by bolts 138 threaded into the end caps. Bolts 138 are received in slots 142 in extension plates 140 (FIG. 4) which, in turn, are bolted to end plates 118 so as to space the entire vibratory screed 106 rearwardly behind auger assembly 104 to provide a space for mounting of oscillating/reciprocating engaging member 108 as described hereinafter. By tightening or loosening the nuts on bolts 138, the angle of vibratory screed 106 can be changed with respect to the vertical.

Tubular members 132, 134 are secured in their vertically spaced positions by a series of spacer plates 144 welded at spaced intervals along the lengths of the tubes. Each spacer plate 144 includes bracing plates or gussets 146 welded on either side thereof adjacent the spacer plates. End gussets 150 (FIG. 4) are provided at the ends of the vibratory unit. Along the lower side of tubular member 134 is a channel member 152 providing a generally planar, concrete engaging screed strip which extends continuously from one end of the screed 106 to the other. As is best seen in FIG. 5, screed channel 152 is secured to tube 134 by means of semicircular hanger brackets 154 positioned in a saddle-like manner over the top of tube 134. Each bracket 154 is aligned with a pair of mounting blocks 158 on either side of channel 152 at each hanger bracket position. Threaded rods 156 extend from each side hanger bracket 154 into mounting blocks 158 and are secured by nuts to hold the channel tightly against the underside of tube 134. As described in U.S. Pat. No. 4,930,935, one or more deflection/adjusting assemblies may be provided along the length of lower tube 134 to adjust the position of the screed channel 152 at various locations along its length such that the overall shape of channel 152 may be trued to avoid sags or curves along its length.

As is best seen in FIG. 4, vibration for screed 106 is provided by a rotatable shaft 160 mounted in a series of bearing pillow blocks 162, one bearing block on each of the support plates 144 along the length of the screed. Shaft 160 extends through one end support plate 150 to an hydraulic motor 164 which rotates shaft 160 in either clockwise or counterclockwise direction as determined by hydraulic fluid directed to the motor through appropriate hydraulic lines. A series of weights are bolted to shaft 160 eccentrically with respect to the shaft axis and immediately adjacent bearings 162 by U-bolts to cause vibration of assembly 106 when hydraulic motor 164 is operated to rotate shaft 160. Yet, because screed 106 is mounted on screed assembly 100 with rubber mounts 136, vibration of screed 106 is isolated from the remainder of the screed assembly.

As is best seen in FIGS. 4, 5, 7 and 8, screed assembly 100 also includes an oscillating/reciprocating engaging member 108 to facilitate consolidation of the uncured concrete after grading and spreading by auger assembly 104 and prior to vibratory contact, smoothing and finishing by vibratory screed assembly 106. Oscillating/reciprocating engaging member 108 includes an elongated, rectilinear, tubular beam formed from metal or plastic having an elongated strip 172 welded or otherwise secured to the bottom surface of the beam. Preferably, strip 172 has inclined or beveled leading and trailing edges 174, 176 to facilitate flow of concrete thereunder as screed assembly 100 is moved. The elongated engaging member 108 formed by beam 170 and strip 172 is supported for reciprocal movement parallel to the axis of rotational auger assembly 104 by means of a pair of support brackets 178 and a pair of oscillating assemblies 180, 182 which are bolted to the brackets 178 (FIGS. 4, 5 and 7–12). As shown in FIGS. 4, 5 and 7–10, brackets 178 are bolted to the top surface of support beam 116 and include gusseted attachment portions 184 and vertically oriented attachment plates 186 which are cantilevered outwardly to the rear of support beam 116. Oscillating assembly 180 differs from support assembly 182 by the inclusion of an hydraulic motor for powering the reciprocating movement of the engaging member 108 formed by beam 170 and strip 172.

As is best seen in FIGS. 4 and 9–12, oscillating support assemblies 180, 182 include mounting posts 188 bolted to the inside surfaces of vertical attachment plates 186 on brackets on 178 and include slotted slide channels 190 therein receiving flanged mounting plates 192. Mounting plates 192 are slidably received in slots 190 for vertical sliding movement to enable adjustment of engaging member 108 toward and away from the material to be screeded such as poured, uncured concrete. Vertically oriented supports 194 are bolted to flanged mounting plates 192 by means of a pair of spaced rubber or other resilient material vibration isolating cylindrical mounts 196. At the lower end of vertical supports 194 are a pair of parallel through apertures 198 in which cylindrical sleeve bearings 200 are mounted, each bearing sleeve receiving a cylindrical slide rod 202. Slide rods 202 are secured between a pair of upstanding, generally triangularly shaped supports 204 bolted to the top surface of beam 170. Accordingly, beam 170 and strip 172 are free to oscillate/reciprocate to and fro on slide rods 202 in bearing sleeves 200 such that the entire engaging member can move laterally across the path of travel of screed assembly 100.

Figures 9, 10, 11, 12:
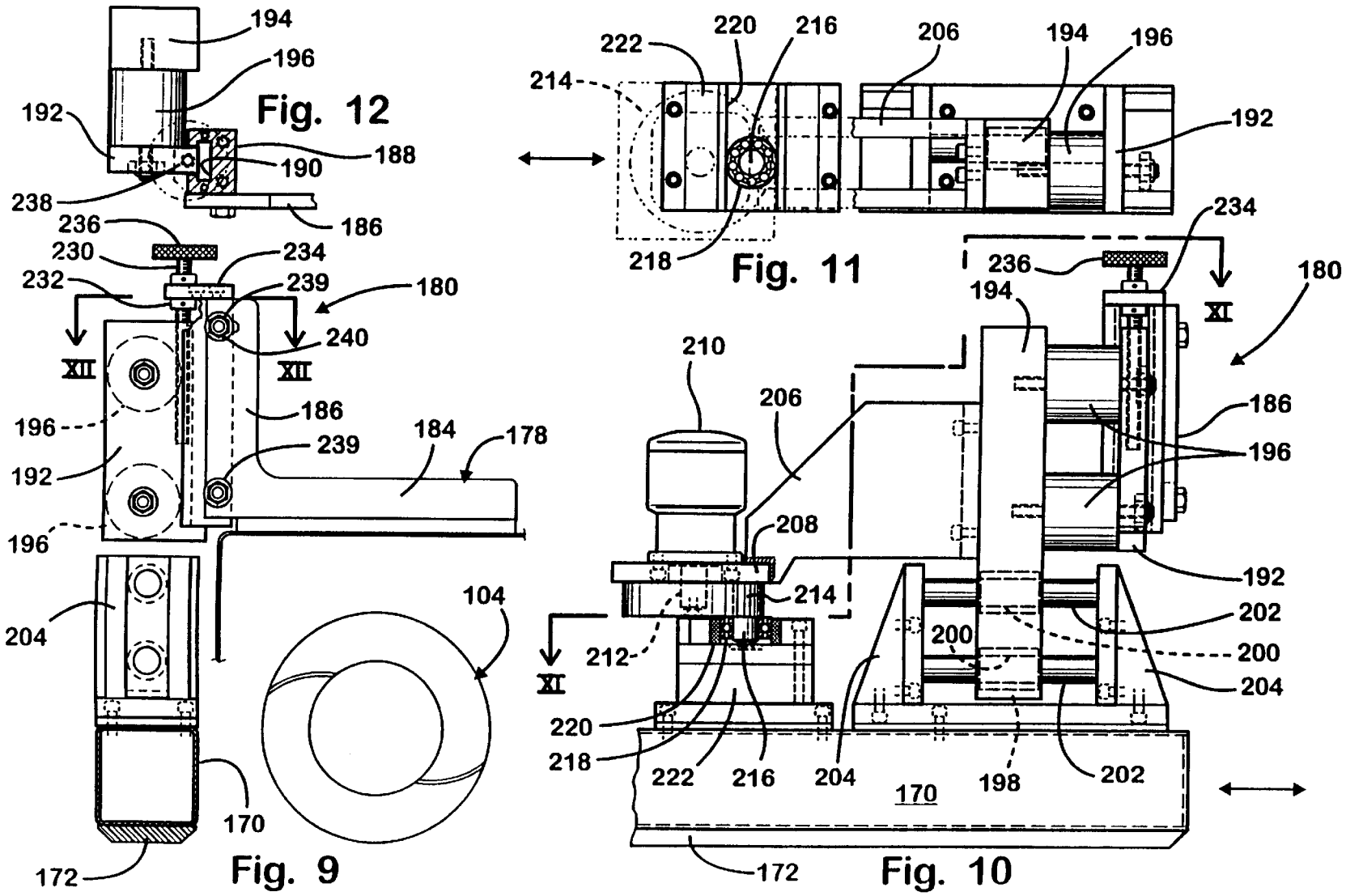
FIG. 9 is a fragmentary, sectional end elevation of a portion of the screeding assembly illustrating the support for the engaging member and oscillating assembly.
FIG. 10 is a fragmentary front elevation of the oscillating assembly for reciprocating the engaging member of the present invention.
FIG. 11 is a top plan view of the oscillating assembly of FIG. 10.
FIG. 12 is a top plan view of the adjustment assembly for the oscillating assembly and engaging member of the present invention taken along plane XII—XII of FIG. 11.

Support assembly 180 also includes motive power means for oscillating or reciprocating the elongated engaging member in contact with the material to be screeded. As is best seen in FIGS. 10 and 11, assembly 180 includes a generally triangular motor support 206 bolted to support 194 and having a horizontal plate 208 welded or otherwise secured thereto and supporting an hydraulic motor 210 thereon. The rotational shaft 212 of motor 210 projects through plate 208 and supports a circular plate 214 for rotation under plate 208. A cam shaft 216 is secured near the perimeter of circular plate 214 and projects downwardly for engagement with the inner race of a bearing assembly 218 having its outer race slidably mounted in a rectilinear channel 220 on the top surface of upstanding support 222 which is bolted to the top surface of beam 170. Accordingly, when hydraulic motor 210 is operated, circular plate 214 is rotated under support plate 208 causing movement of cam shaft 216 in a rotational path which, in turn, causes bearing assembly 218 to move to and fro in channel 220 along with beam 170 and strip 172 in the direction of the arrow in FIGS. 10 and 11 while bearing assembly 218 slides and/or rolls back and forth in channel 220 in a direction transverse to the reciprocating motion of beam 170 and strip 172. Accordingly, hydraulic motor 210 imparts reciprocating motion to the beam 170 and strip 172 as supported on slide rods 202 in bearing sleeves 200 via the cam and roller connection between support 222 and rotating motor shaft 212.

As shown in FIG. 13, a preferred hydraulic system for controlling the oscillation/reciprocation of oscillating engaging member 108 via hydraulic motor 210 is provided by admitting hydraulic fluid under pressure from pump 82 and motor 80 through line 90 to a manually adjustable fluid flow control valve 92 and a manually operable spool valve 94 mounted on platform 24 to rotate hydraulic motor 210 in either a clockwise or counterclockwise direction, as desired. Fluid is returned through the spool valve 94 via return line 96 and hydraulic fluid filter 86 to reservoir 84. Preferably, the flow of hydraulic fluid pressure through spool valve 94 to hydraulic motor 210 is set to reciprocate engaging member 108 at about 30 to 70 oscillations per minute, depending on the speed of movement of the screed assembly 100 over the material to be screeded and the condition of the material such as stiffer concrete, including low slump, partially set, or large aggregate concrete.

Vertical adjustment of the position of engaging member 108 with respect to the material to be screeded is accomplished by means of a threaded rod 230 mounted in bearings 232 on support plates 234 bolted to the top of each mounting post 188 (FIGS. 9 and 12) in each oscillating assembly 180, 182. Threaded rods 230 each include a larger diameter adjustment knob 236 at the top end which is intended for manual rotation by an operator of the screeding assembly prior to use. Each threaded rod 230 extends downwardly into a tapped hole 238 (FIG. 12) extending into the length of the respective flanged mounting plate 192. Accordingly, clockwise or counterclockwise rotation of adjustment knobs 236 on assemblies 180, 182 causes lowering or raising, respectively, of the oscillating/reciprocating engaging member 108 formed by tubular beam 170 and strip 172. The angle of the oscillating assembly to the vertical may be adjusted by loosening bolts 239 and moving the top end of the oscillating assembly in slot 240 provided in attachment plate 186 (FIG. 9).

As is best seen in FIGS. 1–6, screed assembly 100 is preferably pivotally mounted about a pair of orthogonal pivot axes at each end of the screed assembly with respect to the screed elevation beam 50 by means of an electro-hydraulic leveling assembly 250 (FIG. 5). Assembly 250 includes a rectangular pivot yoke 252 (FIG. 6) fitted between laterally spaced portions of end plates 118, 118*a* and secured for pivotal movement in a vertical plane on a generally horizontal axis 110 extending parallel to the direction of elongation of the screed assembly by means of securing bolts 254 and bushings 256 passing through plates 118, 118*a* and pivot yoke 252. An hydraulic fluid cylinder 258 is pivotally secured to the upright end plates 118, 118*a* by means of a laterally extending pivot axle 260 secured to one end of the cylinder and pivotally mounted in bushings 262 extending inwardly from end plates 118, 118*a*. Cylinder rod 259 extends from the opposite end of fluid cylinder 258 and is secured by a pivot pin 266 between a pair of spaced upright plates 264 which are rigidly secured to one end of pivot yoke 252. The horizontal pivot axis 110 provided by yoke 252 and bolts and bushings 254, 256 is vertically aligned and centered above the rotational axis of auger assembly 104 as is best seen in FIG. 5. Accordingly, operation of the fluid cylinder 258 to extend cylinder rod 259 causes counterclockwise rotation of the screed assembly about the axis on bolts and bushings 254, 256 as shown in FIG. 5, thereby raising plow 102 and lowering engaging member 108 and vibratory screed 106. However, retraction of cylinder rod 259 raises engaging member 108 and vibratory screed 106 and lowers plow 102 by causing clockwise rotation around the horizontal pivot axis 110. In either case, since the rotational auger is vertically aligned with the pivot axis, rotation via fluid cylinder 258 causes little or no variation in the position or height of rotational auger 104. Positioning of plow/striker 102 ahead of auger 104, oscillating engaging member 108 and vibratory screed 106 prevents "tearing" of the concrete surface which could otherwise occur if the plow/striker followed the auger. With the preferred arrangement of the screed assembly 100, the grade is very accurately established and the consolidation, smoothing and finishing carried out by the trailing oscillating/reciprocating engaging member and vibratory screed is considerably easier.

Fluid cylinder 258 is controlled to automatically position screed assembly 100 on axis 110 provided by bolts 254 and maintain proper contact of plow 102, oscillating/reciprocating assembly 108, and vibratory screed 106 using an electronic level sensor 112 bolted to the inside surface of upper end plate 118*a* as shown in FIG. 4 or elsewhere on the screed support beam 116. Sensor 112 detects an out of level condition whenever screed assembly 100 rotates 0.1° due to the force and pressure of concrete engaging plow 102 and tending to deflect the screed assembly and the plow downwardly thereby raising the oscillating engaging member 108 and vibratory screed 106. Detection of the rotation of 0.1 or more degrees rotation sends a signal to the electronic control circuit 114 connected to the electrical system and battery 85 of the screeding apparatus 10 as shown in FIG. 5. Control 114, in turn, sends a signal to a solenoid operated hydraulic valve 270 which directs pressurized hydraulic oil to the appropriate side of fluid cylinder 258 to bring the screed assembly 100 back to a level condition and to counteract the force of the concrete exerted against plow 102. A manually adjustable flow control valve 272 is included to control the amount of fluid flow through valve 270 and, thus, the speed at which cylinder 258 causes rotation about axis 110. The speed is set with flow control valve 272 at a slow enough rate to assure smooth operation without over shooting. Although flow control valve 272 has a flow control range of from about 0 to approximately 5 gallons per minute, it is preferably set to allow flow to solenoid operated valve 270 at a rate of less than 1 cubic inch per minute. A fluid lock valve 274 is included between valve 270 and cylinder 258 to prevent undesired rotation of the screed assembly about axis 110. Although a load sensing hydraulic system including a load sensing pump 82 is shown for screeding apparatus 10, a non-load sensing system could also be used. Preferably, level sensing unit 112 is that sold under model number KS 10201 by Sauer Sundstrand Co. of Ames, Iowa.

Also, alternate power sources other than cylinders 258 may be substituted to rotate screed assembly 100 on axis 110 such as hydraulic motors rotating threaded rods engaging pivotable members on yokes 252.

Screed assembly 100 is mounted on and controlled for elevation on screed elevation control assembly 50. As is best seen in FIGS. 1–3 and 6, elevation assembly 50 includes a rectilinear screed elevation beam 280 secured to the underside of boom mount assembly 42 such that beam 280 extends perpendicular to the axial extent of boom assembly 40. Beam 280 includes vertically extending cylindrical tubes 282, 284 on its respective ends through which are slidably mounted inner screed elevation tubes 286, 288 on bearings pressed inside tubes 282, 284. The lower end of each inner screed elevation tube 286, 288 includes a tubular pivot foot 290 (FIG. 6) which is slightly smaller than the internal lengthwise dimension of pivot yoke 252 such that it may be pivotally secured inside yoke 252 by pivot bolt 292 passing through the yoke in a direction orthogonal or perpendicular to the horizontal direction of elongation of screed assembly 100 and the horizontal pivot axis 110 provided by bolts 254 and bushings 256 described above. Pivot bolts 292 at either end of the screed assembly on screed elevation tubes 286, 288 allow the lateral tilt of the screed assembly to be adjusted by raising and lowering tubes 286, 288. Thus, the lateral incline or slope of beam 280, and thus plow/striker 102, auger assembly 104, oscillating engaging member 108 and vibratory screed 106 mounted thereon may be adjusted with respect to beam 280 to various slopes and ground contours.

In order to raise and lower screed assembly 100, each elevation tube 286, 288 is vertically movable by means of an extendable hydraulic cylinder 294, 296 pivotally mounted between flanges 298, 300 extending inwardly from the exterior of the vertically extending outer tubes 282, 284 immediately above screed elevation beam 280. When hydraulic fluid pressure is applied to the head end of cylinders 294, 296, the pistons are extended raising tubes 286, 288 along with screed assembly 100. If an incline or slope for the screed assembly 100 is desired, one or the other of the tubes may be raised or lowered via cylinders 294, 296, without movement of the other. As explained below, such elevation is typically controlled automatically through a laser beacon reference control system, although manual override of such system can be accomplished through operator controlled valving on platform 24 to raise and/or lower screed assembly 100 at a different pace.

As will be understood from FIGS. 1–3, a laser beacon reference plane control system for automatically controlling the elevation of screed assembly 100 by means of elevation tubes 286, 288 is substantially similar to that used in the apparatus of U.S. Pat. Nos. 4,655,633 and 4,930,935. The control system includes a pair of laser receiver mounting masts 302, 304 extending vertically upwardly from elevation tubes 282, 284. A laser beacon receiver 52 is removably secured to each mast by a screw type clamp. Receivers 52 are 360° omnidirectional receivers which detect the position of a laser reference plane such as that provided by a long range rotating laser beacon projector of which many are commercially available. The projector (not shown) is preferably positioned remote from the screeding apparatus 10 adjacent to the area on which the concrete or other material is to be finished. The rotating laser beacon reference plane generated by the projectors is received and detected by laser receivers 52 which then generate electric signals transmitted through appropriate electrical connections 53, including cable E extending along boom 40, to laser control circuits on platform 24, one being providing for each elevation and hydraulic cylinder 294, 296. The control circuits are commercially available and receive and process the signals from the laser receivers 52 and transmit electrical signals to laser controlled, solenoid operated hydraulic valves as described in U.S. Pat. No. 4,655,633 which are connected by appropriate hydraulic lines to hydraulic cylinders 294, 296. Accordingly, when hydraulic pressure from hydraulic pump 82 is applied to the solenoid valves, the valves allow pressure into cylinders 294, 296 as controlled by the electronic control circuits, and cylinders 294, 296 raise or lower screed assembly 100 in relation and reference to the laser beacon reference plane provided by the off vehicle projector. The control circuits provide proportional time value outputs for driving the solenoid valves and automatic elevation control when the changes in elevation of the screed assembly 100 are minimal, but allow manual override and gross adjustment of the screed assembly elevation by the machine operator when desired. Regardless of whether the screeding operation takes place with the machine in a fixed position with boom assembly 40 being withdrawn inwardly toward the machine for screeding concrete adjacent the machine, or the machine is driven through freshly placed and/or poured concrete with the boom rotated to a position behind the vehicle and the screed assembly is fixed at a position behind axle 16 on boom 40, automatic elevation control of the screed assembly 100 will take place via the laser beacon reference control system in the above manner.

PREFERRED OPERATION AND METHOD

As will now be understood, screeding apparatus 10 is used to screed uncured concrete or other like materials. Apparatus 10 is preferably moved with boom assembly 40 in a retracted position such that screed assembly 100 is close in to the vehicle while elevation cylinders 294, 296 are fully raised. The speed of the vehicle may be controlled by adjusting manual valves adjacent the operator. When in position, upper frame 20 is rotated such that boom assembly 40 is substantially perpendicular to the left side of lower frame 12 as shown in FIGS. 1–3. Stabilizer cylinders 34 are first extended such that foot pads 35 raise the lefthand tires 18 slightly off the ground. Thereafter, the right side stabilizers 34 are lowered to contact their foot pads 35 with the ground and raise the right side of the apparatus slightly more than the left side such that boom assembly 40 is at an approximate 2% grade with the tip of the boom lower than the boom support structure 46 and the boom approximately one-half way extended. Such slope allows more efficient operation of the laser operated screed elevation control system as described below. Thereafter, the control valves for the screed elevation cylinders 294, 296 are set to move those cylinders at a rate of about 24 to 28 inches per minute and the laser beam projector is set up adjacent the poured concrete area of the apparatus 10. Laser receivers 52 are positioned on masts 302, 304 such that they receive the laser plane projection for control of the screed elevation. In addition, the screed assembly 100 is checked to determined whether the screed strip 152 has any sags or unevenness along its length. If so, one of the screed deflection adjustment assemblies is used to increase or decrease tension on the member and raise or lower the various portions of the screed strip preferably using a string line such that the screed strip is trued along the string line when stretched beneath the screed.

In addition, set up assemblies 310 (FIGS. 1, 4 and 8) are engaged at either end of screed assembly 100 by pressing spring-biased shoes 312 downwardly with a grade stick on which a separate laser receiver is mounted until the spring biased shoe 312 is even with the lowermost edge of auger assembly 104. If the position of the auger 104 as measured in such manner is higher or lower than required for the proper grade, the screed assembly is adjusted up or down via the controls adjacent the operator prior to the start of screeding.

Screeding is begun by actuating the appropriate hand controlled fluid valve to retract the boom assembly 40 slowly while controlling the speed of retraction with a flow control on the valve. Typically, the speed of the boom retraction is set at about 15 to 20 feet per minute although this depends on the slump of the concrete, the accuracy desired, and the height to which the concrete was poured. Typically, strips of concrete are finished at a width of 10 to 11 feet per pass using approximately 1 foot overlap between strips while occasionally checking the grade with a stick or level eye between passes. Positioning the boom at approximately a 2% grade allows the screed assembly to rise slightly as it progresses toward the machine. As a result, when the screed assembly starts out on target with the projected laser beam, it will rise slightly above the target within a short distance and the elevation control system will lower it back to the target. This pattern repeats continuously resulting in a sawtooth pattern with an approximately ⅛th inch amplitude thereby avoiding any dead band area of the screed control apparatus and more accurately controlling the elevation of the finished screed.

As screed assembly 100 is retracted on boom assembly 40 as shown in FIGS. 1–3, plow 102 removes excess concrete, rotational auger 104 removes and/or distributes the concrete passing beneath the plow by moving the concrete laterally with respect to the direction of movement of the boom and screed assembly, while oscillating/reciprocating assembly 108 and vibrating screed 106 consolidate and smooth the concrete. Typically, as shown in FIG. 5, screed assembly 100 is set such that plow 102 is approximately ¾ inch higher than auger assembly 104, and auger assembly 104 is approximately ¼ inch higher than the material engaging surface of oscillating engaging member 108 or vibratory screed 106. Such settings do not alter the grade established by the plow/striker 102 and auger assembly 104. The oscillation of engaging member 108, which is in engagement with the uncured concrete or other material being screeded, greatly helps consolidate the concrete by reducing the number of voids and openings in large aggregate concrete, low slump concrete, or stiffer concrete such as that which is partially set. The oscillation of engaging member 108 on the concrete, followed closely by the contact of vibratory screed strip 152, properly smooths and finish the concrete and allows movement of screed assembly 100 over such stiffer concrete at generally the same rate of retraction of boom assembly 40 or movement of apparatus 10 through the concrete with screed assembly 100 therebehind as would otherwise be possible with freshly poured, uncured concrete or higher slump concrete.

During operation, screed assembly 100 may be deflected due to horizontal pressure of the concrete buildup in front of the plow/striker 102 and the slope change at the end of the boom assembly as it travels from extended to withdrawn position. Since rotational auger assembly 104 and its centerline are mounted directly below pivot axis 110 of the screed assembly, auger 120 will remain on grade regardless of such angular deflection in the screed assembly. In essence, screed assembly 100 rotates about the axis of the auger during operation. Such deflection causes plow 102 to lower slightly and oscillating member 108 and vibratory screed 106 to rise slightly relative to the auger. If such rotation is large enough, plow 102 could lower sufficiently to be below auger 120 and oscillating member 108 and vibratory screed 106 would be lifted out of contact with the concrete causing inconsistent smoothing, significant voids in the concrete surface, and possible "tearing" of the concrete surface.

The present invention controls this problem by automatically sensing the rotation position of screed assembly 100 with level sensor 112 which controls fluid cylinders 258 at either end of the screed assembly to cause pivotal rotation around axis 110 on bolts 254. Allowable rotation on the axis 110 is ±7° in the preferred embodiment although normal corrections during screeding are in the ¼–1½° range with corrections occurring each time the screed assembly 100 rotates 0.1° out of level. When sufficient rotational movement is detected by level sensor 112, a signal is sent by the sensor to control circuit 114 which in turn relays a signal to solenoid operated hydraulic valve 270 to direct pressurized hydraulic oil to the appropriate side of cylinders 258 to counteract the force of the concrete on the plow and bring the screed assembly back to a level condition. As above, since the auger is vertically aligned with axis 110, and elevation cylinders 294, 296, the position of auger 104 is substantially maintained and moves only nominally during such adjustments.

At the same time that screed assembly deflection is compensated for automatically, vibratory screed 106 and oscillating engaging member 108 are being operated with hydraulic motors 164 and 210. Resilient, isolation mounts 136 and 196 substantially isolate all such vibration and oscillation from the remainder of the screed assembly so that plow 102 and rotational auger 104 maintain efficient operation to grade, distribute and level the concrete. Simultaneously, the elevation of screed assembly 100 is constantly monitored by the laser beam receivers 52 to maintain the elevation of the screed assembly at the proper level. In addition, screed assembly 100 may be adjusted for various slopes and inclines laterally with respect to the direction of movement of the boom assembly 40 and screed assembly 100 by pivoting the screed at either end about the parallel axes provided by bolts 292 which are positioned orthogonally with respect to the axis of bolts 254. This same elevation and screed assembly rotational compensation will occur if the screed assembly is positioned behind the screed apparatus for screeding as the machine 10 is driven through the uncured concrete. Elevation can be also controlled by a computer mounted on the operator platform and including appropriate software to vary the elevation of the screed assembly in relation to the fixed laser plane to provide vertical curves in the concrete, conical services for drains, or other contours in the concrete.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow including the doctrine of equivalents.

The embodiments of the invention in which an exclusive property or privilege is claimed are as follows:

1. A screeding assembly for loose or plastic materials previously placed on the ground or another support surface, and especially placed and/or poured, uncured, concrete, said assembly adapted to be supported and moved along a path in a predetermined direction over an area of the material to be screeded, said assembly comprising:

a support;

an elongated rotatable auger having an axis of rotation generally transverse to said predetermined direction and mounted on said support to move the material laterally of said predetermined direction and grade the material;

a vibratory screed mounted on said support and positioned behind said auger with respect to said predetermined direction to smooth the material;

an elongated engaging member mounted on said support and positioned intermediate said auger and said vibratory screed to engage and smooth the material, and an oscillating assembly which reciprocates said engaging member in a direction generally parallel to said axis of rotation of said auger whereby the material is spread across said path, graded, and smoothed at a desired height above the ground/support surface by said screening assembly when said screening assembly is moved in said predetermined direction along said path; and a pivot axis extending generally parallel to said axis of rotation of said auger, said screeding assembly including said support said auger, said vibratory screed, and said elongated engaging member being pivotally movable about said pivot axis whereby contact of at least said vibratory screed and said elongated engaging member with the material being screeded may be varied and adjusted.

2. The screeding assembly of claim 1 including an elongated plow/striker mounted on said support and spaced in front of said auger with respect to said predetermined direction to remove excess material and spread the material as said screeding assembly is moved in said predetermined direction, said plow/striker also being pivotally movable about said pivot axis with said screeding assembly whereby contact of said plow/striker, vibrator screed, and elongated engaging member may be varied and adjusted.

3. The screeding assembly of claim 2 wherein said plow/striker is also mounted for pivotal movement about said pivot axis.

4. The screeding assembly of claim 2 wherein said vibratory screed has a generally planar material engaging surface.

5. The screeding assembly of claim 4 wherein said engaging member has a generally planar material engaging surface; said auger having a lowermost edge which is positioned slightly above said material engaging surfaces of said engaging member and said vibratory screed when engaged with the material.

6. The screeding assembly of claim 1 wherein said engaging member has a generally planar material engaging surface.

7. The screeding assembly of claim 1 including an adjustment assembly for raising and lowering said elongated engaging member with respect to the material to be screeded.

8. The screeding assembly of claim 7 wherein said adjustment assembly includes a slide support mounted on said support, said oscillating assembly being mounted on said slide support, and a manually operable adjustment member operable to slidably move said slide support and oscillating assembly with respect to said support toward and away from the material.

9. The screeding assembly of claim 8 wherein said manual adjustment member is a threaded, rotatable rod threadably engaging said slide support.

10. The screeding assembly of claim 8 including a plurality of resilient vibration isolating mounts positioned between said slide support and said oscillating assembly.

11. The screeding assembly of claim 9 including at least one vibration isolation member for isolating any vibration of said engaging member and said oscillating assembly from said support, said auger and said vibratory screed.

12. The screeding assembly of claim 7 including an elongated plow/striker mounted on said support and spaced in front of said auger with respect to said predetermined direction to remove excess material and spread the material as said screeding assembly is moved in said predetermined direction.

13. The screeding assembly of claim 1 including a motive power unit for pivoting said screeding assembly about said pivot axis.

14. The screeding assembly of claim 1 wherein said oscillating assembly is also mounted for pivotal movement about said pivot axis with said screeding assembly.

15. A screeding assembly for loose or plastic materials previously placed on the ground or another support surface, and especially placed and/or poured, uncured concrete, said assembly adapted to be supported and moved along a path in a predetermined direction over an area of the material to be screeded, said assembly comprising:

a support;

an elongated rotatable auger having an axis of rotation generally transverse to said predetermined direction and mounted on said support to move the material laterally of said predetermined direction and grade the material;

a vibratory screed mounted on said support and positioned behind said auger with respect to said predetermined direction to smooth the material;

an elongated engaging member mounted on said support and positioned intermediate said auger and said vibratory screed to engage and smooth the material;

an oscillating assembly which reciprocates said engaging member in a direction generally parallel to said axis of rotation of said auger whereby the material is spread across said path, graded, and smoothed at a desired height above the ground/support surface by said screening assembly when said screening assembly is moved in said predetermined direction along said path; and an adjustment assembly for raising and lowering said elongated engaging member with respect to the material to be screeded;

said oscillating assembly including at least one slide member on said engaging member, a bearing member on said support for slidingly supporting said slide member, a camming member attached to said engaging member, and a motor for moving said camming member to reciprocate said slide member and engaging member on said bearing member.

16. The screeding assembly of claim 15 wherein said vibratory screed includes a rotatable shaft having eccentric weights thereon and a motor for rotating said rotatable shaft; said auger including a motor for rotating said auger on said axis of rotation.

17. The screeding assembly of claim 16 wherein said motor for moving said camming member, said motor for rotating said rotatable shaft, and said motor for rotating said auger are hydraulic motors.

18. A screeding assembly for loose or plastic materials previously placed on the ground or another support surface, and especially placed and/or poured uncured concrete said assembly adapted to be supported and moved along a path in a predetermined direction over an area of the material to be screeded, said assembly comprising:

a support, an elongated rotatable auger having an axis of rotation generally transverse to said predetermined direction and mounted on said support to move the material laterally of said predetermined direction and grade the material;

a vibratory screed mounted on said support and positioned behind said auger with respect to said predetermined direction to smooth the material;

an elongated engaging member mounted on said support and positioned intermediate said auger and said vibratory screed to engage and smooth the material; and an oscillating assembly which reciprocates said engaging member in a direction generally parallel to said axis of rotation of said auger whereby the material is spread across said path, graded, and smoothed at a desired height above the ground/support surface by said screening assembly when said screening assembly is moved in said predetermined direction along said path;

said oscillating assembly including at least one slide member on said engaging member, a bearing member on said support for slidingly supporting said slide member, a camming member attached to said engaging member, and a motor for moving said camming member to reciprocate said slide member and engaging member on said bearing member.

19. An improved screeding apparatus for loose or plastic materials previously placed on the ground or another support surface, and especially placed and/or poured, uncured concrete said apparatus being of the type including a support for supporting said apparatus on the ground or a support surface, a boom extending outwardly from said support, a boom support which mounts the boom on the support, a screed assembly, and a screed mount for mounting said screed assembly on said boom, said improvement comprising:

said screed assembly being elongated and including an elongated rotatable auger having an axis of rotation generally transverse to said predetermined direction and mounted on said screed mount to move the material laterally of said predetermined direction and grade the material;

a vibratory screed mounted on said screed mount and positioned behind said auger with respect to said direction to smooth the material;

an elongated engaging member mounted on said screed mount and positioned intermediate said auger and said vibratory screed to engage and smooth the material, and an oscillating assembly which reciprocates said engaging member in a direction generally parallel to said axis of rotation of said auger whereby the material is spread across said path, graded and smoothed at a desired height above the ground/support surface by said screed assembly when said screed assembly is moved in said predetermined direction along said path.

20. The screeding assembly of claim 19 including an adjustment assembly for raising and lowering said elongated engaging member with respect to the material to be screeded.

21. The screeding assembly of claim 20 wherein said oscillating assembly includes at least one slide member on said engaging member, a bearing member on said screed mount for slidingly supporting said slide member, a camming member attached to said engaging member, and a motor for moving said camming member to reciprocate said slide member and engaging member on said bearing member.

22. The screeding assembly of claim 20 wherein said adjustment assembly includes a slide support mounted on said screed mount, said oscillating assembly being mounted on said slide support, and a manually operable adjustment member operable to slidably move said slide support and oscillating assembly with respect to said screed mount toward and away from the material.

23. The screeding assembly of claim 22 wherein said manual adjustment member is a threaded, rotatable rod threadably engaging said slide support.

24. The screeding assembly of claim 20 including at least one vibration isolation member for isolating any vibration of said engaging member and said oscillating assembly from said support, said auger and said vibratory screed.

25. The screeding assembly of claim 24 wherein including a plurality of resilient, vibration isolating mounts positioned between said slide support and said oscillating assembly.

26. The screeding assembly of claim 20 wherein said vibratory screed includes a rotatable shaft having eccentric weights thereon and a motor for rotating said rotatable shaft; said auger including a motor for rotating said auger on said axis of rotation.

27. The screeding assembly of claim 26 wherein said motor for moving said camming member, said motor for rotating said rotatable shaft, and said motor for rotating said auger are hydraulic motors.

28. The screeding assembly of claim 19 including an elongated plow/striker mounted on said screed mount and spaced in front of said auger with respect to said predetermined direction to remove excess material and spread the material as said screed assembly is moved in said predetermined direction.

29. The screeding apparatus of claim 28 including a pivot assembly for pivotally mounting said screed assembly on a first pivot axis extending generally parallel to the direction of elongation of said screed assembly, and a motive power unit for pivoting said screed assembly about said pivot axis whereby contact of said plow/striker, engaging member and vibratory screed with the material may be varied and adjusted.

30. The screeding apparatus of claim 29 including a level sensor on said screed assembly for sensing the position and degree of rotation of said screed assembly about said first pivot axis and a control responsive to said level sensor which actuates said motive power unit to pivot said screed assembly about said first pivot axis.

31. The screeding apparatus of claim 30 wherein said motive power unit includes a fluid cylinder mounted on said screed assembly and engaging a pivot yoke mounted on said screed mount, said pivot yoke including said first pivot axis and a second pivot axis extending perpendicular to said first pivot axis.

32. The screeding apparatus of claim 31 wherein said fluid cylinder and pivot yoke are mounted at one end of said screed assembly; said motive power unit including a second fluid cylinder mounted at the opposite end of said screed assembly and engaging a second pivot yoke mounted on said screed mount, said second pivot yoke including said first pivot axis and a third pivot axis extending parallel to said second pivot axis.

33. The screeding apparatus of claim 29 including means for moving said elongated screed assembly along and over the material in said predetermined direction generally perpendicular to said direction of elongation whereby said motive power unit allows pivoting of said screed assembly to counteract the force of the material engaging said screed assembly during movement and maintain proper screeding contact with the material.

34. The screeding apparatus of claim 33 wherein said means for moving said elongated screed assembly include a telescoping boom assembly having a plurality of boom sections movable with respect to one another and with respect to said support; said screed assembly being mounted at one end of one of said boom sections; said boom support including a boom power source for extending and retracting said boom sections with said screed assembly thereon.

35. The screeding apparatus of claim 34 including two boom sections, one of said boom sections being larger than the second boom section, said second boom section being nested within said first boom section, said first boom section being nested within said support; a plurality of bearings on said support, said first boom section and said second boom section which movably support said first and second boom sections with respect to one another and said support.

36. The screeding apparatus of claim 34 wherein said means for moving said elongated screed assembly also include a propulsion unit on said support for moving said support and said entire screeding apparatus over the ground or support surface.

37. The screeding apparatus of claim 33 wherein said means for moving said elongated screed assembly include a propulsion unit on said support for moving said support and said entire screeding apparatus over the ground or support surface.

38. The screeding apparatus of claim 33 wherein said screed mount includes an elevation assembly for raising and lowering said screed assembly with respect to said boom.

39. The screeding apparatus of claim 38 including a laser beam responsive control on said screed assembly responsive to a fixed laser reference plane for controlling the raising and lowering of said screed assembly with said elevation assembly.

40. The screeding apparatus of claim 38 wherein said screed mount includes a generally horizontal screed elevation beam rigidly secured to said boom; said screed assembly including a support beam; said plow/striker, rotatable auger, engaging member and vibratory screed being mounted on said support beam.

41. The screeding apparatus of claim 40 including means for vibrationally isolating engaging member and said vibratory screed from said support beam whereby said engaging member and vibratory screed may be operated without affecting the operation of said rotational auger and plow/striker.

42. The screeding apparatus of claim 40 wherein said vibratory screed includes a pair of vertically spaced elongated supports extending across said screed assembly, resilient mounting means for mounting said supports on said support beam, an elongated screed strip mounted on the lowermost support for engaging the material, brace means for vertically spacing said supports, and rotatable shaft means mounted on said brace means and having eccentric weights thereon for vibrating said screed assembly when rotated.

43. The screeding apparatus of claim 38 including at least a second pivot axis extending in a direction perpendicular to said first pivot axis.

44. The screeding apparatus of claim 43 wherein said elevation assembly includes a screed elevation beam rigidly mounted horizontally on said screed mount, spaced elevation tubes secured to said screed assembly at opposed ends of said screed elevation beam, power means for raising and lowering said elevation tubes with respect to said elevation beam, one of said elevation tubes secured to said screed assembly at one end about said first and second pivot axes, the other of said elevation tubes secured to the opposite end of said screed assembly about said first pivot axis and a third pivot axis extending parallel to said second pivot axis.

45. The screeding apparatus of claim 44 wherein said screed assembly includes a support beam; said plow/striker, rotatable auger, engaging member and vibration means being mounted on said support beam; said first, second and third pivot axes extending between said elevation beam and said support beam.

46. The screeding apparatus of claim 45 wherein said motive power means include a fluid cylinder mounted on said support beam and engaging a pivot yoke attached to one of said elevation tubes for pivoting said screed assembly, said pivot providing said first pivot axis and one of said second and third pivot axes.

47. The screeding apparatus of claim 46 including a level sensor on said screed assembly for sensing the position and degree of rotation of said screed assembly about said first axis and a control responsive to said level sensor which actuates said fluid cylinder to pivot said screed assembly about said first pivot axis.

48. The screeding apparatus of claim 47 including means for vibrationally isolating said engaging member and said vibratory screed from said support beam whereby said engaging member and vibratory screed may be operated without affecting the operation of said rotational auger and plow/striker.

49. The screeding apparatus of claim 19 wherein said screed mount includes an elevation assembly which raises and lowers said screed assembly with respect to said boom.

50. The screed apparatus of claim 49 wherein said elevation assembly includes a screed elevation beam rigidly mounted on said screed mount, spaced elevation tubes secured to said screed assembly at opposed ends of said screed elevation beam, and a pair of fluid cylinders for raising and lowering said elevation tubes with respect to said elevation beam, one of said elevation tubes secured to said screed assembly at one end, the other of said elevation tubes secured to the opposite end of said screed assembly.

51. The screeding apparatus of claim 49 including a laser beam responsive control on said screed assembly responsive to a fixed laser reference plane for controlling the raising and lowering of said screed assembly with said elevation assembly.

52. A screeding assembly for loose or plastic materials previously placed on the ground or another support surface, and especially placed and/or poured, uncured concrete, said assembly adapted to be supported and moved along a path in a predetermined direction over an area of the material to be screeded, said assembly comprising:

a support;

an elongated rotatable auger having an axis of rotation generally transverse to said predetermined direction and mounted on said support to move the material laterally of said predetermined direction and to grade the material at a predetermined height above the ground/support surface;

a vibratory screed mounted on said support and positioned behind said auger with respect to said predetermined direction to smooth the material;

an elongated engaging member mounted on said support and positioned intermediate said auger and said vibratory screed to engage and smooth the material, and an oscillating assembly which reciprocates said engaging member in a direction generally parallel to said axis of rotation of said auger whereby the material is spread across said path, graded, and smoothed at a desired height above the ground/support surface by said screeding assembly when said screeding assembly is moved in said predetermined direction along said path; and an elongated plow/striker mounted on said support and spaced in front of said auger with respect to said predetermined direction to remove excess material and spread the material as said screeding assembly is moved in said predetermined direction.

53. The screeding assembly of claim 52 further including a pivot axis extending generally parallel to said axis of rotation of said auger, said screeding assembly including said support, said plow/striker, said auger, said vibratory screed, and said elongated engaging member being pivotally movable about said pivot axis whereby contact of at least said plow/striker, said vibratory screed and said elongated engaging member with the material being screeded may be varied and adjusted.

54. The screeding assembly of claim 53 including a motive power unit for pivoting said screeding assembly about said pivot axis.

55. The screeding assembly of claim 53 wherein said oscillating assembly is also mounted for pivotal movement about said pivot axis with said screeding assembly.

* * * * *

UNITED STATES PATENT AND TRADEMARK OFFICE

CERTIFICATE OF CORRECTION

PATENT NO. : 6,183,160 B1 
DATED : February 6, 2001
INVENTOR(S) : John A. Tapio, Nels D. Tapio and Kyle J. Tapio It is certified that error appears in the above-identified patent and that said Letters Patent is hereby corrected as shown below:

Column 17,
Lines 25 and 26, “screening” should be -- screeding --
Line 30, insert -- , -- after “support”

Column 18,
Lines 49 and 50, “screening” should be -- screeding --

Column 19,
Line 11, “,” should be -- ; -- after “support”
Lines 27 and 28, “screening” should be -- screeding --
Line 39, insert -- , -- after “concrete”

Column 21,
Line 50, insert -- said -- after “isolating”

Signed and Sealed this

Eleventh Day of May, 2004

JON W. DUDAS
*Acting Director of the United States Patent and Trademark Office*